US009605690B2

(12) United States Patent
Taguchi

(10) Patent No.: US 9,605,690 B2
(45) Date of Patent: Mar. 28, 2017

(54) HYDRAULIC SYSTEM

(75) Inventor: Yuichi Taguchi, Okayama (JP)

(73) Assignee: TAGUCHI INDUSTRIAL CO., LTD., Okayama-Shi (JP)

( * ) Notice: Subject to any disclaimer, the term of this patent is extended or adjusted under 35 U.S.C. 154(b) by 289 days.

(21) Appl. No.: 14/374,854

(22) PCT Filed: Jan. 31, 2012

(86) PCT No.: PCT/JP2012/052100

§ 371 (c)(1),
(2), (4) Date: Jul. 25, 2014

(87) PCT Pub. No.: WO2013/114556

PCT Pub. Date: Aug. 8, 2013

(65) Prior Publication Data

US 2015/0033723 A1 Feb. 5, 2015

(51) Int. Cl.
*F15B 11/20* (2006.01)
*F15B 11/02* (2006.01)

(52) U.S. Cl.
CPC ..... *F15B 11/20* (2013.01); *F15B 11/022* (2013.01); *F15B 2211/405* (2013.01); *F15B 2211/40576* (2013.01); *F15B 2211/41527* (2013.01); *F15B 2211/428* (2013.01); *F15B 2211/7053* (2013.01); *F15B 2211/7121* (2013.01); *F15B 2211/783* (2013.01)

(58) Field of Classification Search
CPC ..... F15B 11/022; F15B 11/22; F15B 11/205; F15B 11/20; F15B 2211/7107; F15B 2211/7121; F15B 2211/7142; F15B 2211/76; F15B 2211/88; F15B 21/14; F15B 13/07
See application file for complete search history.

(56) References Cited

U.S. PATENT DOCUMENTS

| | | | | |
|---|---|---|---|---|
| 4,455,921 A * | 6/1984 | Griesbach | ..... | F04B 15/02 417/342 |
| 5,199,658 A | 4/1993 | Bartels et al. | | |
| 6,742,334 B2 | 6/2004 | Fan | | |
| 6,973,780 B2 | 12/2005 | Hahn et al. | | |

FOREIGN PATENT DOCUMENTS

| | | |
|---|---|---|
| JP | 05-065769 A | 3/1993 |
| JP | 2007-298072 A | 11/2007 |
| JP | 2011-038627 A | 2/2011 |
| JP | 2011-094740 A | 5/2011 |

* cited by examiner

*Primary Examiner* — Eric Keasel
*Assistant Examiner* — Michael Quandt
(74) *Attorney, Agent, or Firm* — Fox Rothschild LLP

(57) ABSTRACT

A hydraulic system, wherein an actuating cylinder and an accelerating cylinder each includes a piston, a rod, and a tube. When the rod of the actuating cylinder extends in an unloaded condition, a circuit is configured such that oil discharged from the bottom-side section of the accelerating cylinder is supplied to the bottom-side section of the actuating cylinder through a bottom line. When the rod of the actuating cylinder extends in a loaded condition, a circuit is configured such that oil supplied to the bottom line without passing through the accelerating cylinder is supplied to the bottom-side section of the actuating cylinder. The circuit for the unloaded condition and the circuit for the loaded condition is switched based on a pressure sensing in the bottom line.

8 Claims, 6 Drawing Sheets

HYDRAULIC SYSTEM

TECHNICAL FIELD

The present invention relates to a hydraulic system including so actuating cylinder and an accelerating cylinder added to configure an acceleration circuit.

BACKGROUND ART

As a hydraulic circuit for accelerating extension of a rod of a hydraulic cylinder, an acceleration circuit is known. For example, if the accelerating circuit is used for the hydraulic cylinder of a crusher, extension of the rod is accelerated to speed up a closing operation of a movable jaw. In the acceleration circuit disclosed in Patent Document 1, an inversion cylinder (an accelerating cylinder) is interposed between an actuating cylinder and a pump. According to this configuration, by interposing the inversion cylinder, the flow rate of oil supplied to the bottom side of the actuating cylinder is increased more than the flow rate of oil supplied from the pump to accelerate the extension of the rod of the actuating cylinder. This speeds up the closing operation of the movable jaw and reduces the operation time for crushing.

In the acceleration circuit of Patent Document 1, however, although the flow rate of oil supplied to the actuating cylinder increases, the oil pressure reduces and the thrust of the actuating cylinder decreases. Therefore, in a loaded condition, oil is directly supplied from the pump to the actuating cylinder by switching the circuit with a switch valve to exert the intrinsic thrust. In other words, the acceleration circuit of Patent Document 1 configures a function-selecting mechanism that switches priority between flow rate and thrust as described in Patent Document 1.

PRIOR ART DOCUMENTS

Patent Document

Patent Document 1: Japanese Patent Application Publication No. 2011-38627

DISCLOSURE OF INVENTION

Problems to be Solved by Invention

In the acceleration circuit of Patent Document 1, the pressure in the bottom-side line, which is an oil supplying line, rises in leaded condition. As illustrated in FIG. 1 and FIG. 2 of Patent Document 1, pilot lines 31, 41, 51 of switch valves 3 to 5, which switch circuits for the loaded condition and the unloaded condition, are connected to a bottom-side line 6 to sense a pressure rise in the bottom-side line 6 and to switch the circuit for the unloaded condition to the circuit for the loaded condition. It is theoretically possible that a pressure sensing position for switching the circuits is set in the bottom-side line 6 in this way.

However, the inventor of this application conducted experiments on the acceleration circuit of Patent Document 1 and confirmed that the switching operation was unstable with the pressure sensing position set in the bottom-side line 6.

The thinkable reason is as follows, though the details is provided later.

As described above, in the circuit for unloaded condition, the flow rate of oil supplied to the bottom side of the actuating cylinder increases and oil pressure reduces.

Therefore, if the bottom-side line, which is an oil supplying line, is connected to the bottom side of the actuating cylinder, whose oil pressure is reduced, in the loaded condition; the pressure in the bottom side line, which has risen once, drops temporarily.

Such a pressure drop causes switching back to the circuit for unloaded condition in spite of the presence of load, and makes the switching operation unstable.

The present invention solves the above-described conventional problem and aims to provide a hydraulic system including an actuating cylinder and an accelerating cylinder added to configure an acceleration circuit, in which a switching operation from an unloaded condition to a loaded condition is stable.

Means for Solving Problems

In order to achieve the object above, the present invention provides a hydraulic system including an actuating cylinder and an accelerating cylinder. The actuating cylinder and the accelerating cylinder each include a piston, a rod that moves integrally with the piston, and a tube that contains the piston and the rod. The tube is divided into a rod-side section on the rod side and a bottom-side section on the opposite side to the rod with the piston interposed therebetween. The hydraulic system further includes a switch valve that switches a circuit for unloaded condition and a circuit for loaded condition, a supply/discharge line that is a source of oil supply, and a bottom line that allows connection between the bottom-side section of the accelerating cylinder and the bottom-side, section of the actuating cylinder. When the rod of the actuating cylinder is extended in unloaded condition, a circuit is configured such that oil is supplied from the supply/discharge line to the rod-side section of the accelerating cylinder and oil discharged from the bottom-side section of the accelerating cylinder is supplied to the bottom-side section of the actuating cylinder through the bottom line. When the rod of the actuating cylinder is extended in loaded condition, a circuit is configured such that oil from the supply/discharge line is supplied to the bottom-side section of the actuating cylinder without passing through the accelerating cylinder. The switch valve switches the circuit for unloaded condition to the circuit for leaded condition based on a pressure in the bottom line.

In this configuration, if oil is supplied to the rod-side section of the accelerating cylinder in unloaded condition, oil is supplied from the bottom-side section of the accelerating cylinder to the bottom-side section of the actuating cylinder through the bottom line, whereby the rod of the actuating cylinder is extended. Since the rod passes through the rod-side section of the accelerating cylinder, the flow rate of oil discharged from the bottom-side section of the accelerating cylinder is greater than the flow rate of oil supplied to the rod-side section. Accordingly, the flow rate of oil supplied to the bottom-side section of the actuating cylinder through the bottom line increases, whereby the extension of the rod of the actuating cylinder is accelerated.

Since the rod is integral with the piston, the area or the piston in the rod-side section is smaller than the area of the piston in the bottom-side section. In this case, the pressure in the bottom-side section is smaller than the pressure in the rod-side section because of balance of power acting on the piston. The pressure in the bottom line that connects the bottom-side section of the accelerating cylinder with the bottom-side section of the actuating cylinder is therefore smaller than the pressure in the supply/discharge line that supplies oil to the rod-side section of the accelerating cylinder in unloaded condition. That is, the supply/discharge line is in a higher pressure side and the bottom line is in a lower pressure side. In the present invention, in a loaded condition, a circuit is configured such that oil is supplied to the bottom-side section of the actuating cylinder without passing through the accelerating cylinder, whereby the thrust of the rod of the actuating cylinder is secured. In this case, the supply/discharge line of oil in the high pressure side is connected to the bottom line in the lower pressure side, so that the pressure in the bottom line rises.

In the present invention, the circuit for unloaded condition is switched to the circuit for loaded condition based on the pressure in the bottom line. If the bottom line reaches a setting pressure, the circuit for unloaded condition switches to the circuit for loaded condition. Since the bottom line is on the lower pressure side, once the bottom line is connected to the line on the higher pressure side due to the circuit switching, the pressure in the bottom line rises. In this case, the bottom line does not fall below the setting pressure for pressure sensing, and the circuit for loaded condition is maintained, resulting in a stable switching operation from the unloaded condition to the loaded condition.

In the hydraulic system of the present invention, following variations may be adaptable. The switch valve may include a first switch valve interposed in the bottom line. The bottom line may include a first bottom line that connects the bottom-side section of the accelerating cylinder with the first switch valve and a second bottom line that connects the bottom-side section of the actuating cylinder with the first switch valve. The first switch valve may connect the first bottom line and the second bottom line in the unloaded condition and connect the supply/discharge line and the second bottom line in the loaded condition based on a pressure in the second bottom line. In this case, the position of pressure sensing can be brought closer to the actuating cylinder, and the responsiveness of the switching operation in the loaded condition can be enhanced.

A volume of oil in the accelerating cylinder may be larger than a volume of oil in the actuating cylinder. In this case, even in a state in which the rod of the actuating cylinder is fully extended, a capacity allowing the piston to move can be left in the bottom-side section of the accelerating cylinder, thereby ensuring the intrinsic amount of extension of the rod of the actuating cylinder. Even in a state in which the rod of the actuating cylinder is fully retracted, a capacity allowing the piston to move can be left in the rod-side section of the accelerating cylinder, thereby making it possible to ensure the intrinsic amount of retraction of the rod of the actuating cylinder.

The hydraulic system further may include a first relief line in which a first relief valve is interposed. The first relief valve may be opened by the pressure of oil supplied to the rod-side section of the accelerating cylinder when the rod of the actuating cylinder is extended in unloaded condition. In case the rod of the actuating cylinder is to be extended it the unloaded condition when the rod of the accelerating cylinder is fully retracted before the rod of the actuating cylinder is fully extended, oil that has been supplied to the rod-side section of the accelerating cylinder may be supplied to the bottom-side section of the actuating cylinder through the first relief line. In this configuration, lacking in the amount of extension of the rod of the actuating cylinder can be prevented even in a case where synchronization between the actuating cylinder and the accelerating cylinder is imperfect when the rod of the actuating cylinder is to be extended in unloaded condition. In addition, synchronization between the actuating cylinder and the accelerating cylinder can be restarted in a state in which the positional relationship between the piston of the actuating cylinder and the piston of the accelerating cylinder is returned to a normal position.

When the rod of the actuating cylinder is extended in the loaded condition, a circuit may be configured such that oil discharged from the rod-side section of the actuating cylinder is supplied to the rod-side section of the accelerating cylinder. The hydraulic system may further include a second, relief line in which a second relief valve is interposed. The second relief valve may be opened by the pressure of oil discharged from the rod-side section of the actuating cylinder when the rod of the actuating cylinder is extended in the loaded condition. In case the rod of the actuating cylinder is to be extended in the loaded condition when the rod of the accelerating cylinder is fully retracted before the rod of the actuating cylinder is fully extended, oil that has been discharged from the rod-side section of the actuating cylinder and supplied to the rod-side section of the accelerating cylinder is discharged through the second relief line. In this configuration, lacking in the amount of extension of the rod of the actuating cylinder can be prevented even in a case where synchronization between the actuating cylinder and the accelerating cylinder is imperfect when the rod of the actuating cylinder is to be extended in unloaded condition. In addition, synchronization between the actuating cylinder and the accelerating cylinder can be restarted in a state in which the positional relationship between the piston of the actuating cylinder and the piston of the accelerating cylinder is returned to the normal position.

When the rod of the actuating cylinder is retracted, a circuit may be configured such that oil is supplied to the rod-side section of the actuating cylinder and oil discharged from the bottom-side section of the actuating cylinder is supplied to the bottom-side section of the accelerating cylinder. The hydraulic system may further include a third relief line in which a third relief valve is interposed. The third relief valve may be opened by the pressure of oil discharged from the bottom-side section of the actuating cylinder when the rod of the actuating cylinder is retracted. In case the rod of the actuating cylinder is to be retracted when the rod of the accelerating cylinder is fully extended before the rod of the actuating cylinder is fully retracted, oil that has been discharged from the bottom-side section of the actuating cylinder and supplied to the bottom-side section of the accelerating cylinder is discharged through the third relief line. In this configuration, lacking in the amount of retraction of the rod of the actuating cylinder can be prevented even in a case where synchronization between the actuating cylinder and the accelerating cylinder is imperfect when the rod of the actuating cylinder is to be retracted. In addition, synchronization between the actuating cylinder and the accelerating cylinder can be restarted in a state in which the positional relationship between the piston of the actuating cylinder and the piston of the accelerating cylinder is returned to the normal position.

The accelerating cylinders may be plural. When the rod of the actuating cylinder is extended in unloaded condition, oil may be supplied from the supply/discharge line to the rod-side section of each accelerating cylinder, and oil discharged from the bottom-side section, of each accelerating cylinder may be supplied to the bottom-side section of the actuating cylinder through the bottom line. In this configuration, the volume in each accelerating cylinder can be reduced, and a space required for installation of each accelerating cylinder can also be reduced. An empty space in a target machine in which the hydraulic system is installed thus can be efficiently utilized.

The actuating cylinder may be plural. Oil discharged from the bottom-side section of the accelerating cylinder may be supplied to the bottom-side section of the each actuating cylinder through the bottom line. In this configuration, for example, in a crusher having upper and lower jaws, both the upper and lower jaws can be driven by the actuating cylinder.

The present invention is a hydraulic system that additionally includes an accelerating cylinder to accelerate extension of the rod of the actuating cylinder, in which switching from the circuit for unloaded condition to the circuit for loaded condition is made in unloaded condition, based on the pressure in the bottom line that connects the bottom-side section of the accelerating cylinder with the bottom-side section of the actuating cylinder. Since the bottom line on in the lower pressure side, the pressure in the bottom line rises once the bottom line is connected to the line on the higher pressure side due to the circuit switching. In this case, the bottom line does not fall below a setting pressure for pressure sensing, so that the circuit for loaded condition is maintained, resulting in a stable switching operation from an unloaded condition to a loaded condition.

MODE(S) FOR CARRYING OUT THE INVENTION

Figure 1:
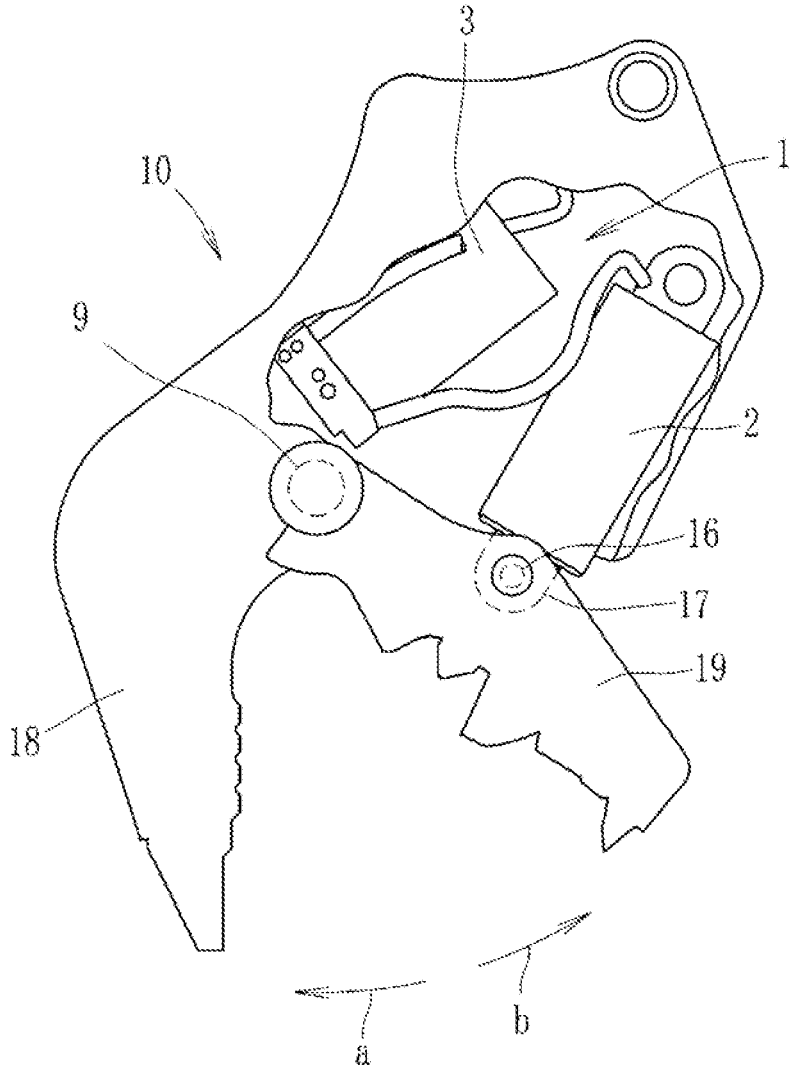
FIG. 1 is a diagram schematically illustrating a crusher with a hydraulic system according to an embodiment of the present invention.

An embodiment of the present invention is described below with reference to the figures. FIG. 1 is a diagram schematically illustrating a crusher 10 with a hydraulic system 1 according to the embodiment of the present invention. FIG. 1 illustrates the interior of the crusher 10 by using a broken line for convenience of explanation. The crusher 10 is an attachment used with a main body such as construction machine and is actuated by the pressure of oil supplied from, the main body.

The crusher 10 has an upper jaw 18 and a lower jaw 19. The lower jaw 19 is pivotably attached to the upper jaw 18 with a pivot shaft 9. An actuating cylinder 2 and an accelerating cylinder 3 are components of the hydraulic system 1 contained in the crusher 10. The hydraulic system 1 configures an acceleration circuit so as to accelerate the extension speed of a rod of the actuating cylinder 2. The details of the hydraulic system 1 are described later with reference to FIGS. 2 to 4.

The actuating cylinder 2 contains the rod, and a lower jaw support 17 moves integrally with the extension/retraction of the rod. The lower jaw 19 is attached to the lower jaw support 17 with a pivot shaft 16. If the rod of the actuating cylinder 2 extends, the lower jaw support 17 integrally moves so as to push the lower jaw 19. The lower jaw 19 then pivots around the pivot shaft 9 and comes closer to the upper jaw 18 (the direction of arrow a). An object to be crashed sandwiched between the upper jaw 18 and the lower jaw 19 is thereby crushed. After crushing the object to be crashed, the rod of the actuating cylinder 2 is retracted, so that the lower jaw 19 pivots in the direction (the direction of arrow b) opposite to the direction during crushing and goes back to the state illustrated in FIG. 1 in which the upper jaw 18 and the lower jaw 19 are fully opened.

Figure 2:
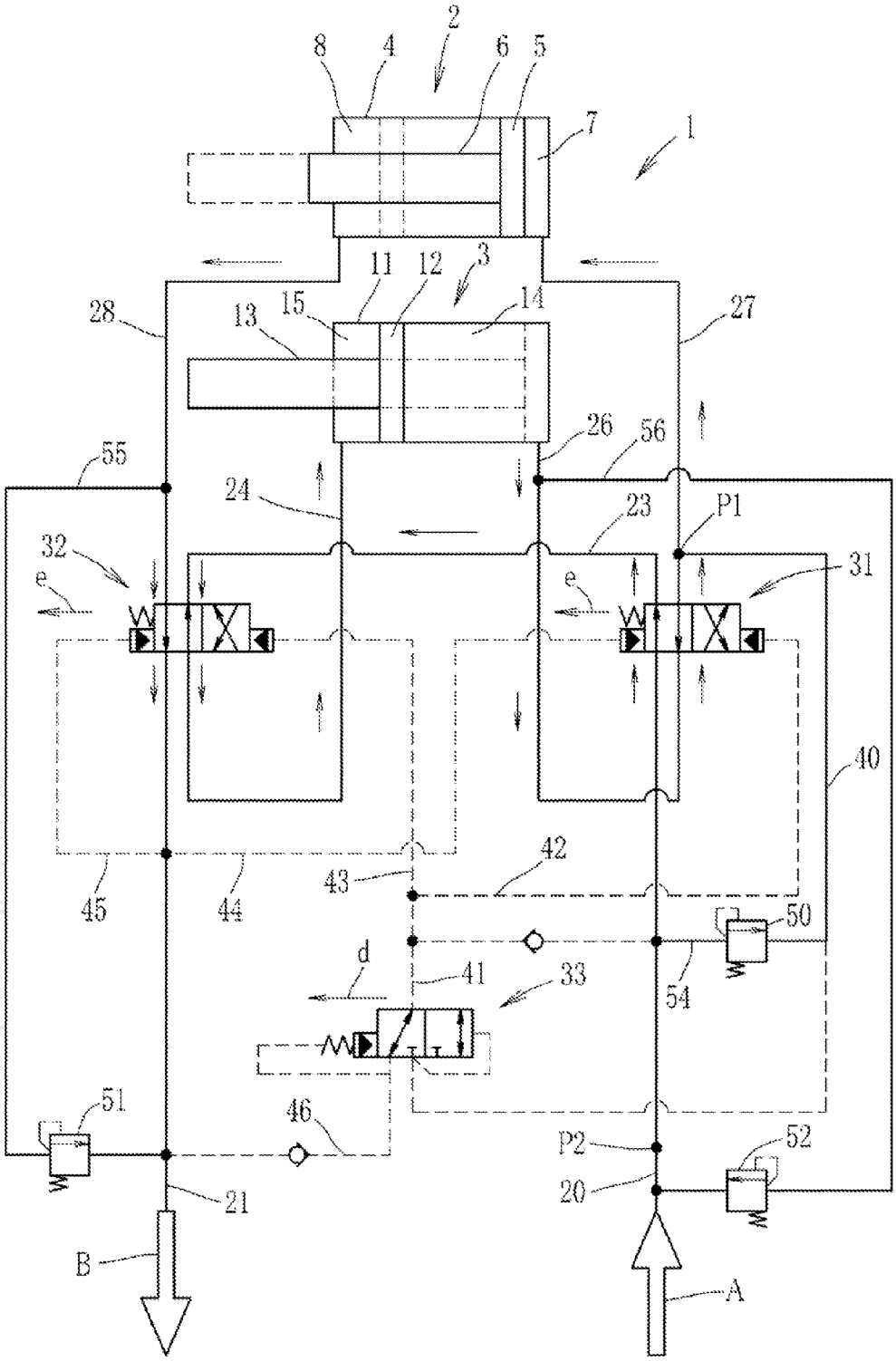
FIG. 2 is a hydraulic circuit diagram in which a rod of an actuating cylinder is extended in the unloaded condition, according to the embodiment of the present invention.
Figure 3:
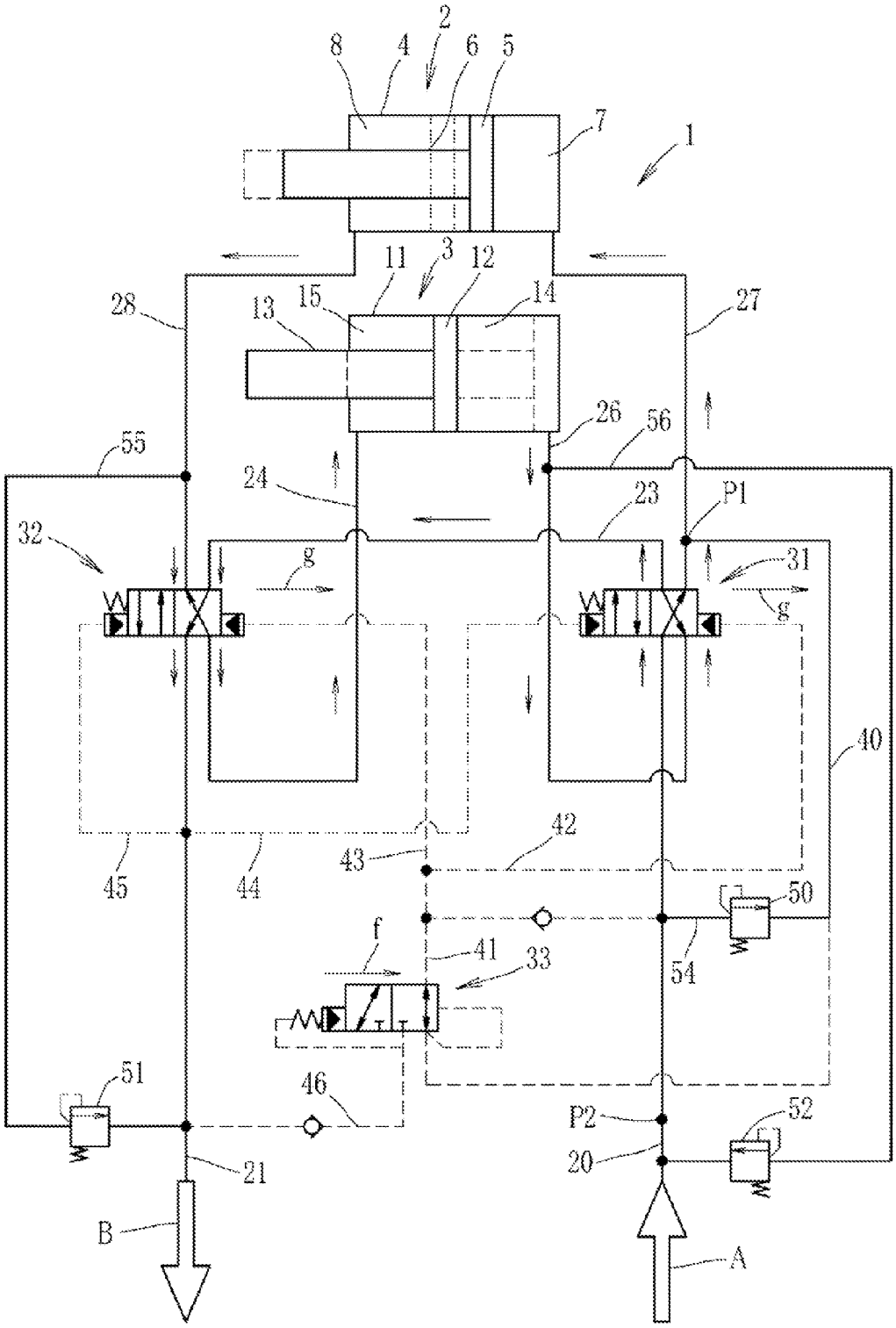
FIG. 3 is a hydraulic circuit diagram in which the rod of the actuating cylinder is extended in the loaded condition, according to the embodiment of the present invention.
Figure 4:
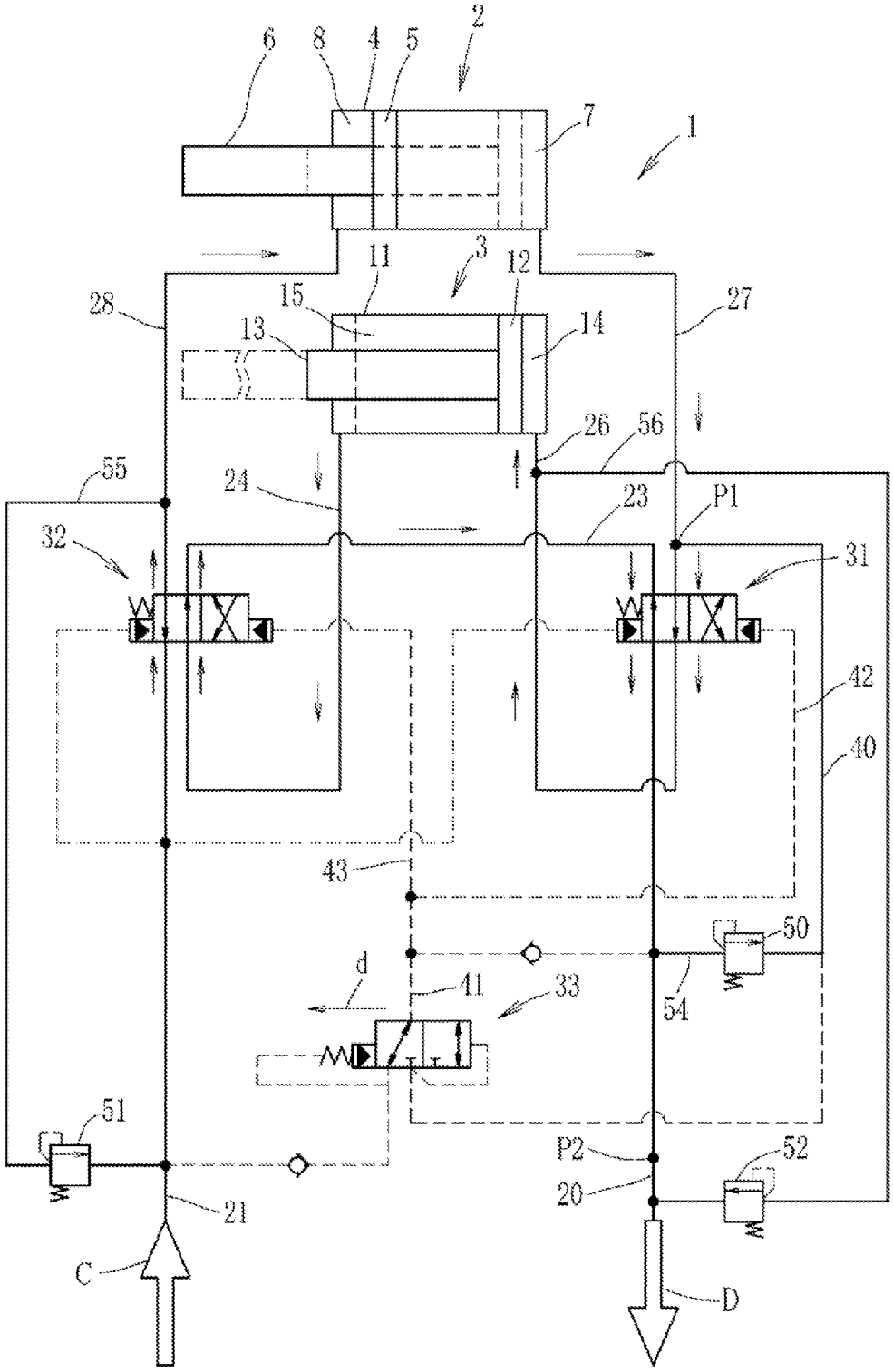
FIG. 4 is a hydraulic circuit diagram in which the rod of the actuating cylinder is retracted, according to the embodiment of the present invention.

FIGS. 2 to 4 are hydraulic circuit diagrams of the hydraulic system 1 according to the embodiment of the present invention. The figures illustrate the hydraulic system 1 having the same configuration. The connection relationship of piping in the hydraulic system 1 is changed depending on the presence or absence of load. FIG. 2 is a hydraulic circuit diagram in which the rod 6 of the actuating cylinder 2 is extended in unloaded condition. FIG. 3 is a hydraulic circuit diagram, in which the rod 6 of the actuating cylinder 2 is extended in loaded condition. FIG. 4 is a hydraulic circuit diagram in which the rod 6 of the actuating cylinder 2 is retracted.

The hydraulic system 1 includes the actuating cylinder 2, the accelerating cylinder 3, a first switch valve 31, a second switch valve 32, and a third switch valve 33. The piping that connects the components forms a flow path through which oil is circulated. The flow path is hereinafter called a "line". The figures only illustrate the main configuration of the hydraulic system 1 and do not illustrate a configuration that is not directly related to the present invention, for example, such as a safety circuit and various valves.

The actuating cylinder 2 contains a piston 5 and the rod 6 integral therewith in a tube 4. The interior of the tube 4 is divided into a rod-side section 8 on the rod 6 side and a bottom-side section 7 on the side opposite to the rod 6 with the piston 5 interposed therebetween. Although not illustrated in FIGS. 2 to 4, the lower jaw support 17 illustrated in FIG. 1 moves integrally with the extension/retraction of the rod 6.

Although the accelerating cylinder 3 has the same configuration as the actuating cylinder 2, the components thereof are denoted with reference signs different from those of the actuating cylinder 2 for a convenience of an explanation. The accelerating cylinder 3 contains a piston 12 and a rod 13 integral therewith in a tube 11. The interior of the tube 11 is divided into a rod-side section 15 and a bottom-side section 14 with the piston 12 interposed therebetween.

If oil is supplied to the bottom-side section 7 of the actuating cylinder 2, the piston 5 moves to allow the rod 6 to extend from the tube 4, and oil is discharged from the rod-side section 8. Since the rod 6 passes through the oil in the rod-side section 8, the flow rate of oil discharged from the rod-side section 8 by the movement of the piston 5 is smaller than the flow rate of supply to the bottom-side section 7. In the present embodiment, the ratio of the flow rate of oil discharged from the rod-side section 8 to the flow rate of oil supplied to the bottom-side section 7 is referred to as a supply-discharge ratio. This is the same with the accelerating cylinder 3. The supply-discharge ratio is 2:1 if oil at a flow rate of "2" is supplied to the bottom-side section 7 and oil at a flow rate of "1" is discharged from the rod-side section 8.

The operation of the hydraulic system 1 in unloaded condition is described with reference to FIG. 2. In the present embodiment, the supply-discharge ratio of the actuating cylinder 2 is 2:1. In this case, the supply-discharge ratio of the accelerating cylinder 3 with the same specifications as the actuating cylinder 2 is also 2:1. In an unloaded condition in FIG. 2, a pump in the main body is operated to supply oil to a supply/discharge line 20 (arrow A). The oil flowed through the hydraulic system 1 is recovered into a tank in the main body through a supply/discharge line 21 (arrow B).

In FIG. 2, the first switch valve 31 connects the supply/discharge line 20 with an intermediate line 23. The second switch valve 32 connects the intermediate line 23 with a first rod line 24. The first switch valve 31 also connects a first bottom line 26 with a second bottom line 27. The second switch valve 32 further connects a second rod line 28 with the supply/discharge line 21.

In this circuit, oil from the supply/discharge line 20 is supplied to the rod-side section 15 of the accelerating cylinder 3 through the intermediate line 23 and the first rod line 24. With the capacity of the rod-side section 15 increasing, the piston 12 moves to reduce the protrusion of the rod 13 from the tube 11. As previously mentioned, the supply-discharge ratio of the accelerating cylinder 3 is 2:1. In this case, when oil at a flow rate of "1" is supplied to the rod-side section 15, oil at a flow rate of "2" is discharged from the bottom-side section 14.

The oil at a flow rate of "2" is supplied to the bottom-side section 7 of the actuating cylinder 2 through the first bottom line 26 and the second bottom line 27. With the capacity of the bottom-side section 7 increasing, the piston 5 moves to allow the rod 6 to extend from the tube 4, and oil is discharged from the rod-side section 8.

As previously mentioned, although oil is supplied to the bottom-side section 15 of the accelerating cylinder 3 at a flow rate of "1", oil is supplied to the bottom-side section 7 of the actuating cylinder 2 at a flow rate of "2". The moving speed of the actuating piston 5 and the rod 6 integral therewith is thereby increased. Since the supply-discharge ratio of the actuating cylinder 2 is 2:1, if oil at a flow rate of "2" is supplied to the bottom-side section 7 of the actuating cylinder 2, oil at a flow rate of "1" is discharged from the rod-side section 8 of the actuating cylinder 2.

If oil at a flow rate of "1" is supplied to the supply/discharge line 20, oil is discharged from the supply/discharge line 21 also at a flow rate of "1" in the sequence of oil flow. In the present embodiment, therefore, although the flow rate of oil that, pushes the piston 5 of the actuating cylinder 2 increases, the flow rate of oil supplied from the pump through the supply/discharge line 20 is equal to the flow rate of oil returned to the tank through the supply/discharge line 21.

In a case where the hydraulic system 1 is used in the crusher 10 provided as an attachment as illustrated in FIG. 1, the usher 10 is attached to a main body such as construction machine to operate. In this configuration, oil is supplied from the main body to the hydraulic system 1 and recovered from the hydraulic system 1 into the main body. The greater the flow rate of oil recovered into the main body is, the greater the pressure loss is. As preciously explained, in the hydraulic system 1 according to the present embodiment, if oil at a flow rate of "1" is supplied from the pump (in the main body), oil that pushes the piston 5 of the actuating cylinder 2 increases to a flow rate of "2". However, the increased flow rate is not maintained when it is recovered. The flow rate of oil recovered into the main body is reduced to the flow rate "1", which is equal to the flow rate of oil supplied from the pump, thereby suppressing pressure loss. According to this, the effect of accelerating the moving speed of the rod 6 of the actuating cylinder 2 is effectively achieved.

The operation of the hydraulic system 1 in the loaded condition is described with reference to FIG. 3 in comparison with FIG. 2. First, the reason why the circuits are switched between an unloaded condition and a loaded condition is described. In the accelerating cylinder 3 in FIG. 2, the area of the piston 12 in the rod-side section 15 is smaller than the area of the piston 12 in the bottom-side section 14 because the rod 13 is integral with the piston 12 in the rod-side section 15. In the present embodiment, the area ratio between both sides of the piston 12 is set at 1:2. In this case, supposing the pressure in the rod-side section 15 is "100", the pressure in the bottom-side section 14 is half, "50", based on the balance of power acting on the piston 12.

In an unloaded condition of FIG. 2, the bottom-side section 14 of the accelerating cylinder 3 is connected with the bottom-side section 7 of the actuating cylinder 2 through the first bottom line 26 and the second bottom line 27. The pressure in the bottom-side section 7 of the actuating cylinder 2 is therefore "50", which is equal to the pressure in the bottom-side section 14 of the accelerating cylinder 3. It follows that even when oil at a pressure of "100" is supplied to the rod-side section 15 of the accelerating cylinder 3, the piston 5 of the actuating cylinder 2 is pushed by oil at a pressure of "50". For this reason, in a loaded condition, the circuit is switched to that of FIG. 3 so as to enhance the thrust of the rod 6 of the actuating cylinder 2. The circuit for loaded condition is described below.

In the present embodiment, in a loaded condition, the circuit for unloaded condition illustrated in FIG. 2 is automatically switched to the circuit fox loaded condition in FIG. 3 based on pressure sensing. In the crusher 10 in FIG. 1, if an object is present between the upper jaw 18 and the lower jaw 19, the crusher 10 operates with the circuit for unloaded condition of FIG. 2 until both the upper jaw 18 and the lower jaw 19 come into abutment with the object.

After both the upper jaw 18 and the lower jaw 19 come into abutment with the object, in FIG. 2, the oil pressure in the bottom-side section 7 of the actuating cylinder 2 rises, and the oil pressure in the second bottom line 27 connected to the bottom-side section 7 also rises accordingly. In the present embodiment, the oil pressure in the second bottom line 27 is sensed in order to switch the circuit for unloaded condition in FIG. 2 to the circuit for loaded condition in FIG. 3. This circuit switching is described below.

In FIG. 2, a pilot line 40 is connected at a point P1 of the second bottom line 27. The first, switch valve 31, the second, switch valve 32, and the third switch valve 33 are kept in the positions in FIG. 2 by spring pressure and valve lines 44 to 46 connected to the supply/discharge line 21. If the pressure in the second bottom line 27 reaches a setting pressure, the pressure in the pilot line 40 rises. This pressure rise makes the third, switch valve 33 to move in the direction of arrow d. In the circuit for loaded condition of FIG. 3, the pilot line 40 and a switch line 41 are thereby connected through the third switch valve 33. The switch line 41 branches into a switch line 42 and a switch line 43.

In the circuit for loaded condition of FIG. 3, therefore, the pressure in the switch line 41 connected to the pilot line 40 rises, and the pressure in the switch line 42 and the switch line 43 branched from the switch line 41 rises as well. This pressure rise moves the first switch valve 31, which is connected to the switch line 42, and the second switch valve 32, which is connected to the switch line 43, in the direction of arrow e from the position in FIG. 2, whereby the circuit in FIG. 2 is switched to the circuit in FIG. 3.

In the circuit of FIG. 3, the oil circulation path is changed from that in the circuit in FIG. 2 due to the positional movement of the first switch valve 31 and the second switch valve 32. The supply/discharge line 20 is connected with the intermediate line 23 through the first switch valve 31 in FIG. 2, whereas the supply/discharge line 20 is connected to the second bottom line 27 through the first switch valve 31 in FIG. 3. In FIG. 3, oil from the supply/discharge line 20 is thereby directly supplied to the bottom-side section 7 of the actuating cylinder 2 through the second, bottom line 27. In other words, the oil pressure in the supply/discharge line 20 directly appears as the oil pressure in the bottom-side section 7. It follows that if oil at a pressure "100" is supplied from the pump in the main body to the supply/discharge line 20, the piston 5 of the actuating cylinder 2 is pushed by oil at a pressure "100", thereby making if possible to enhance the thrust of the rod 6 of the actuating cylinder 2 when compared with the circuit in FIG. 2.

If it is changed from a loaded condition to an unloaded condition, the pressure in the pilot line 40 drops, and the third switch valve 33 in the position in FIG. 3 moves in the direction of ax row f and returns to the position in FIG. 2. Oil in the switch line 42 and the switch line 43 flows into the supply/discharge line 21 through the switch line 41 and the switch line 46, accordingly, then the first switch valve 31 and the second switch valve 32 in the position in FIG. 3 move in the direction of arrow g and return to the position in FIG. 2, thereby switching to the circuit for unloaded condition in FIG. 2.

In the present embodiment, the switching operation from an unloaded condition to a loaded condition is stabilized by setting the pressure sensing position in the second bottom line 27. This is described below. First, for the purpose of comparison, a case where the pressure sensing position is at a point P2 of the supply/discharge line 20 is described.

It is directly understandable that if load is applied to the actuating cylinder 2, the pressure in the supply/discharge line 20 as a source of oil supply rises, and the pressure sensing position for switching to the circuit for loaded condition can be directly set in the supply/discharge line 20. The inventor of this application conducted experiments and found that the pressure sensing position set in the supply/discharge line 20 made the switching operation from an unloaded condition to a loaded condition unstable. The reason for this is understood as follows.

In the circuit for unloaded condition of FIG. 2, in a case where the pressure in the supply/discharge line 20 is "100", the pressure in the supply/discharge line 20 as a source of oil supply exceeds "100" if load is applied to the actuating cylinder 2. The setting pressure at the point P2 for switching to the circuit for loaded condition in FIG. 3 therefore has to be set at a value exceeding "100". Upon switching to the circuit for loaded condition in FIG. 3, the supply/discharge line 20 is connected to the second bottom line 27. As previously described, in the circuit for unloaded condition in FIG. 2, if the pressure in the supply/discharge line 20 is "100", the pressure in the second bottom line 27 is "50".

Immediately after switching to the circuit for loaded condition in FIG. 3, the pressures in the supply/discharge line 20 and the second bottom line 27 is stabilized in an intermediate value between the pressure in the supply/discharge line 20 and the pressure in the second bottom line 27. Specifically, the pressure in the second bottom line 27 in the lower pressure side having a pressure of "50" rises, while the pressure in the supply/discharge line 20 in the higher pressure side having a pressure exceeding "100" drops temporarily.

If the pressure in the supply/discharge line 20 drops, the pressure in the supply/discharge line 20 falls below the setting pressure. In this case, the third switch valve 33 returns to the state in FIG. 2, and the first switch valve 31 and the second switch valve 32 also return to the state in FIG. 2, accordingly to return to the circuit for unloaded condition in FIG. 2. If the loaded state continues, the pressure in the supply/discharge line 20 reaches the setting pressure again, thereby switching to the loaded state in FIG. 3. However, immediately after switching to the circuit for loaded condition in FIG. 3, the pressure in the supply/discharge line 20 temporarily drops to return again to the circuit for unloaded condition in FIG. 2, as previously mentioned. Accordingly, if the pressure sensing position for a loaded condition is on the supply/discharge line 20, the first switch valve 31, the second switch valve 32, and the third switch valve 33 go back and forth between the position in unloaded condition in FIG. 2 and the position in loaded condition in FIG. 3 to make the operation unstable.

By contrast, in the present embodiment, the position of pressure sensing for circuit switching is provided at the point P1 in the second bottom line 27. As previously described, in an unloaded condition, if the pressure in the supply/discharge line 20 is "100", the pressure in the second, bottom line 27 is "50". In the circuit for unloaded condition of FIG. 2, if load is applied to the actuating cylinder 2, the pressure in the bottom-side section 7 exceeds "50" and the pressure in the second bottom line 27 also exceeds "50". Therefore, the setting pressure for switching to the circuit for leaded condition does not have to be set to a value exceeding the pressure "100" of the supply/discharge line 20, and it is satisfied with a value exceeding the pressure "50" of the bottom-side section 7.

If it is switched to the circuit for loaded condition in FIG. 3, the second bottom line 27 in the lower pressure side is connected to the supply/discharge line 20 in the higher pressure side. This causes the pressure in the second bottom line 27 to rise. In other words, in the present embodiment, the position of pressure sensing, which switches it to the circuit for loaded condition, is at the point P1 in the second bottom line 27, whose pressure is increased during switching to the circuit for loaded condition. The second bottom line 27 therefore does not fall below the setting pressure for pressure sensing if it switches to the circuit for loaded condition in FIG. 3. After switching to the circuit for loaded condition in FIG. 3, the third switch valve 33 is kept in the state in FIG. 3, and the first switch valve 31 and the second switch valve 32 are kept in the state in FIG. 3 as well. Therefore, the circuit in FIG. 3 is maintained, resulting in a stable operation.

In the embodiment above, the point P1, which is a position of pressure sensing for switching to the circuit for loaded condition, is on the second bottom line 27. The point P1, however, may be set on the first bottom line 26. This is because, although the second bottom line 27 and the first bottom line 26 are separate lines with the first switch valve 31 interposed therebetween, those lines 27, 26 are lines in the lower pressure side having the same pressure. If the pressure sensing position is set in the second bottom line 27 as in the present embodiment, the pressure sensing position can be brought closer to the actuating cylinder, and the responsiveness of the switching operation in loaded condition can be enhanced.

As described above, the switching operation from an unloaded condition to a loaded condition can be stabilized by setting the position of pressure sensing, which is for switching to the circuit for loaded condition, on the second bottom line 27 or the first bottom line 26.

Synchronization between the actuating cylinder 2 and the accelerating cylinder 3 is described. In the circuit for unloaded condition in FIG. 2, oil discharged from the rod-side section 8 of the actuating cylinder 2 is returned to the tank in the main body through the second rod line 28 and the supply/discharge line 21. Although this circuit may be used in loaded condition too, oil discharged from the rod-side section 8 of the actuating cylinder 2 is supplied to the rod-side section 15 of the accelerating cylinder 3 without directly returning to the tank in the circuit for loaded condition in FIG. 3.

In the circuit in FIG. 3, the second rod line 28 is connected with the first rod line 24 through the second switch valve 32. Oil discharged from the rod-side section 8 of the actuating cylinder 2 is thereby supplied to the rod-side section 15 of the accelerating cylinder 3 connected to the first rod line 24. In this case, the piston 12 of the accelerating cylinder 3 moves by the same amount as the piston 5 of the actuating cylinder 2.

The first bottom line 26 connected to the bottom-side section 14 of the accelerating cylinder 3 is connected with the intermediate line 23 through the first switch valve 31. The intermediate line 23 is also connected with the supply/discharge line 21 through the second switch valve 32. The oil discharged from the bottom-side section 14 of the accelerating cylinder 3 is therefore returned to the tank through the first bottom line 26, the intermediate line 23, and the supply/discharge line 21. Such a flow of oil allows synchronization between the movement of the piston 5 of the actuating cylinder 2 and the movement of the piston 12 of the accelerating cylinder 3 even in loaded condition.

Here, the supply-discharge ratio of the actuating cylinder 2 is 2:1. If oil at a flow rate of "1" is supplied to the bottom-side section of the actuating cylinder 2 in FIG. 3, oil at a flow rate of "0.5" is discharged from the rod-side section of the actuating cylinder 2. The supply-discharge ratio of the accelerating cylinder 3 is also 2:1. If oil discharged from the actuating cylinder 2 at a flow rate of "0.5" is supplied to the rod-side section 15 of the accelerating cylinder 3, oil at a flow rate of "1" is discharged from the bottom-side section 14 of the accelerating cylinder 3. The oil at a flow rate of "1" is returned to the tank in the main body through the supply/discharge line 21 as previously described. It follows that if oil at a flow rate of "1" is supplied to the supply/discharge line 20, oil is discharged from the supply/discharge line 21 also at a flow rate of "1" in the same manner as in the circuit for unloaded condition in FIG. 2. Actually, the flow rate of oil discharged from the supply/discharge line 21 is further reduced due to the load. In the circuit for loaded condition, therefore, the flow rate of oil recovered into the main body such as construction equipment does not increase when compared with the circuit for unloaded condition. The circuit for loaded condition is not disadvantageous in terms of pressure loss due to the recovered flow rate when compared with the circuit for unloaded condition.

The retraction of the rod 6 of the actuating cylinder 2 is described with reference to FIG. 4. In FIG. 4, the connection state of the lines through the first switch valve 31, the second switch valve 32, and the third switch valve 33 is the same as in the circuit for unloaded condition in FIG. 2. In FIG. 4, the flow of oil is opposite to that of the circuit in FIG. 2. Oil is supplied from the pump in the main body to the supply/discharge line 21 (arrow C) and returned from the supply/discharge line 20 to the tank in the main body (arrow D). Oil supplied to the supply/discharge line 21 is supplied to the rod-side section 8 of the actuating cylinder 2 through the second rod line 28.

The piston 5 moves, and the rod 6 is drawn into the tube 4 with the capacity of the rod-side section 8 of the actuating cylinder 2 increasing. As previously described, the supply-discharge ratio of the actuating cylinder 2 is 2:1. When oil at a flow rate of "1" is supplied to the rod-side section 8 of the actuating cylinder 2, oil at a flow rate of "2" is then discharged from the bottom-side section 7 of the actuating cylinder 2.

The oil discharged from the actuating cylinder 2 at a flow rate of "2" is supplied to the bottom-side section 14 of the accelerating cylinder 3 through the second bottom line 27 and the first bottom line 26. With the capacity of the bottom-side section 14 increasing, the piston 12 moves to allow the rod 13 to extend from the tube 11, and oil is discharged from the rod-side section 15.

The supply-discharge ratio of the accelerating cylinder 3 is also 2:1. When oil at a flow rate of "2" is supplied to the bottom-side section 14 of the accelerating cylinder 3, oil at a flow rate of "1" is then discharged from the rod-side section 15 of the accelerating cylinder 3. The oil at a flow rate of "1" is returned to the tank in the main body through the first rod line 24, the intermediate line 23, and the supply/discharge line 20. In the circuit in FIG. 4, therefore, the flow rate of oil recovered into the main body is suppressed to the same flow rate as the flow rate of oil supplied from the main body, thereby making it possible to suppressing pressure loss in the same manner as in the circuits in FIG. 2 and FIG. 3.

If the rod 6 of the actuating cylinder 2 retracts, oil from the pump at a flow rate of "1" is supplied to the rod-side section 8 of the actuating cylinder 2 without increasing the flow rate "1" to retract the rod 6. Therefore, the effect of directly accelerating the retraction of the rod 6 is not obtained when the rod 6 retracts. However, as previously described, pressure loss is suppressed in the circuit of FIG. 4. This can prevent deceleration of the rod 6 of the actuating cylinder 2 due to pressure loss and can accelerate the retraction of the rod 6 when compared with a circuit without the accelerating cylinder 3.

Although an example is raised in which specifications of the actuating cylinder 2 and the accelerating cylinder 3 are identical in the embodiment above, the present invention is not limited to this example. For example, the actuating cylinder 2 and the accelerating cylinder 3 may differ in tube diameter, tube length, and other specifications.

Although an example is raised in which the supply-discharge ratio of both of the actuating cylinder 2 and the accelerating cylinder 3 is 2:1 and is the same in the embodiment above, the cylinders 2 and 3 may have different supply-discharge ratios. For example, the supply-discharge ratio of the accelerating cylinder 3 may be set to 1.9:1, and the supply-discharge ratio of the actuating cylinder 2 may be set to 2:1. In this example, if the flow rate of oil supplied to the rod-side section 15 of the accelerating cylinder 3 is "1", oil at a flow rate of "1.9" is supplied to the bottom-side section 7 of the actuating cylinder 2 to accelerate the moving speed of the rod 6 of the actuating cylinder 2. Since the supply-discharge ratio of the actuating cylinder 2 is 2:1, if oil at a flow rate of "1.9" is supplied to the bottom-side section 7 of the actuating cylinder 2, the flow rate discharged from the rod-side section 8 of the actuating cylinder 2 is halved to a flow rate "0.95". The flow rate recovered into the main body such as construction machine is suppressed to suppress pressure loss. That is, if the actuating cylinder 2 and the accelerating cylinder 3 have different supply-discharge ratios, the accelerating effect and the effect of suppressing pressure loss are obtained as in the case where the supply-discharge ratio is equal.

When the rod 6 of the actuating cylinder 2 in FIG. 4 retracts, if oil at a flow rate of "1" is supplied from the pump to the rod-side section 8 of the actuating cylinder 2, oil at a flow rate of "2" is discharged from the bottom-side section 7 of the actuating cylinder 2. The oil at a flow rate of "2" is supplied to the bottom-side section 14 of the accelerating cylinder 3, and oil at a flow rate of "2/1.9=1.05" is discharged from the rod-side section 15. Although this flew rate is increased from the flow rate supplied from the pump, the flow rate "2" discharged from the bottom-side section 7 of the actuating cylinder 2 is reduced to about a half. Therefore, the flow rate recovered into the main body such as construction machine is reduced to suppress pressure loss.

Figure 5:
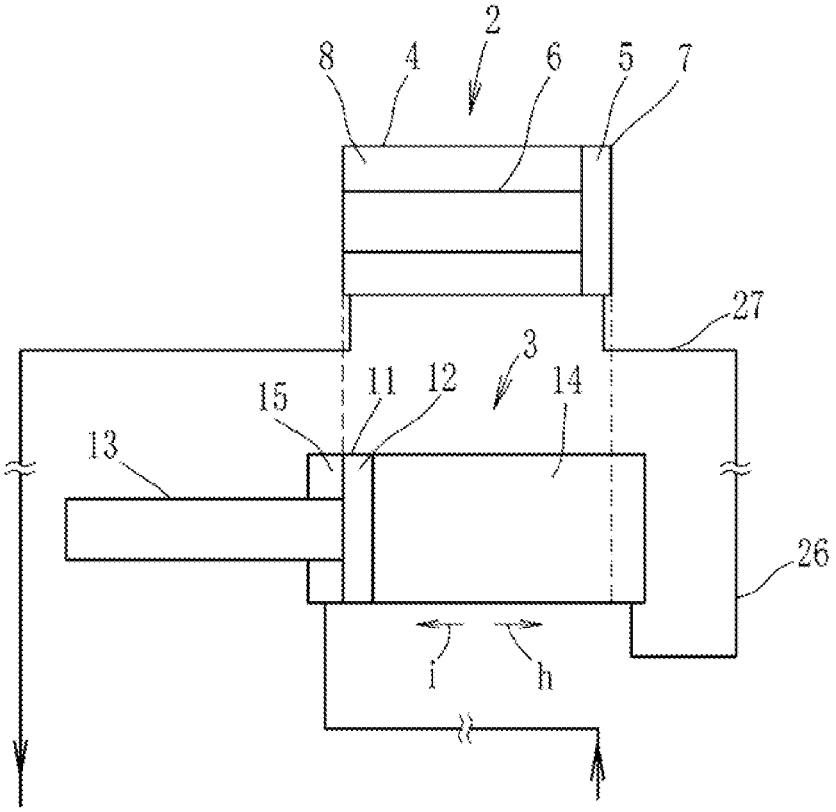
FIG. 5 is a diagram illustrating a state where the rod of the actuating cylinder is fully retracted, according to the embodiment of the present invention.
Figure 6:
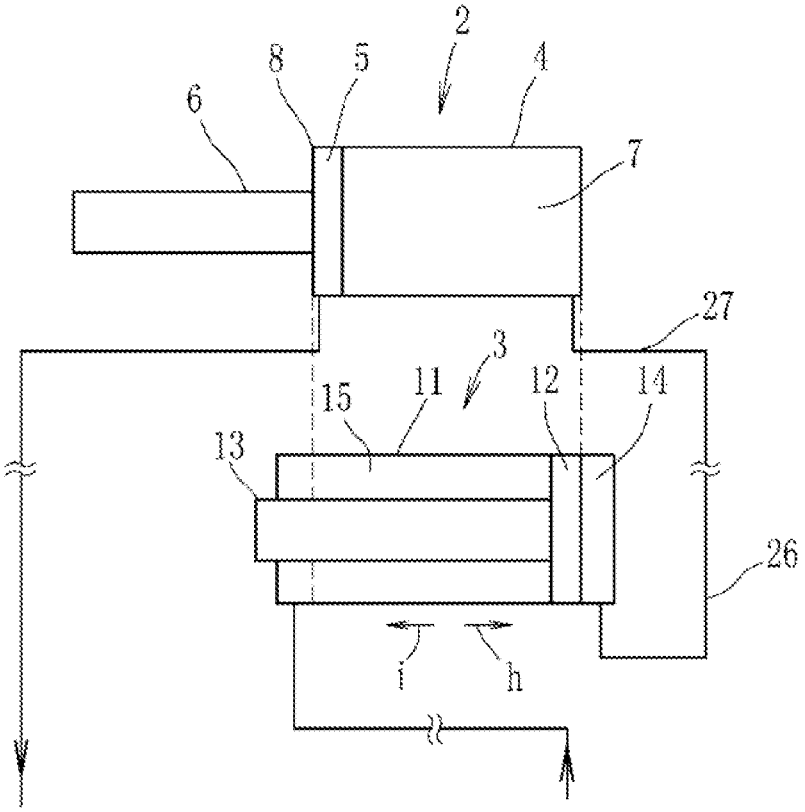
FIG. 6 is a diagram illustrating a state where the rod of the actuating cylinder is fully extended, according to the embodiment of the present invention.

The capacity of oil in the accelerating cylinder 3 may be set larger than the capacity of oil in the actuating cylinder 2. This example is described below. FIG. 5 illustrates a state in which the rod 6 of the actuating cylinder 2 is fully retracted. FIG. 6 illustrates a state in which the rod 6 of the actuating cylinder 2 is fully extended. Although the circuits in FIG. 5 and FIG. 6 are the same as the circuit for unloaded condition in FIG. 2, they are illustrated in simplified form. The tube 11 of the accelerating cylinder 3 has a length longer than the tube 4 of the actuating cylinder 2 and thereby has a larger capacity of oil. The both ends of the tube 4 are illustrated with broken lines in the tube 11. The specifications of those cylinders are the same except the tube length, for convenience of comparison.

In the state illustrated in FIG. 5, if oil is supplied to the rod-side section 15 of the accelerating cylinder 3, the rod 13 is retracted, and oil in the bottom-side section 14 of the accelerating cylinder 3 is supplied to the bottom-side section 7 of the actuating cylinder 2 through the first bottom line 26 and the second bottom line 27. The rod 6 of the actuating cylinder 2 is thereby extended. If oil is kept supplied to the bottom-side section 7 of the actuating cylinder 2, it becomes the state in FIG. 6 in which the rod 6 of the actuating cylinder 2 is fully extended.

In FIG. 6, if the piston 12 of the accelerating cylinder 3 moves to maximum in the direction in which the rod 13 is retracted (the direction of arrow h), oil cannot be discharged from the bottom-side section 14 of the accelerating cylinder 3, and the rod 6 of the actuating cylinder 2 cannot be extended any further. In other words, if the piston 12 moves to maximum in the direction of arrow h before the rod 6 of the actuating cylinder 2 is fully extended, the intrinsic extension amount of the rod 6 of the actuating cylinder 2 cannot be secured.

In the present embodiment, the capacity of oil in the tube 11 of the accelerating cylinder 3 is set larger than the capacity of oil in the tube 4 of the actuating cylinder 2. Because of this, even in a state in which the rod 6 of the actuating cylinder 2 is fully extended as illustrated in FIG. 6, the piston 12 of the accelerating cylinder 3 is not moved to maximum, and a capacity allowing the piston 12 to move is left in the bottom-side section 14. This configuration can prevent the piston 12 of the accelerating cylinder 3 from moving to maximum before the rod 6 of the actuating cylinder 2 fully extends, and can ensure the intrinsic extension amount of the rod 6 of the actuating cylinder 2.

When the rod 6 of the actuating cylinder 2 retracts, the state in FIG. 6 in which the rod 6 is fully extended changes to a state in FIG. 5 in which the rod 6 is fully retracted. As illustrated in FIG. 5, the piston 12 of the accelerating cylinder 3 is not moved to maximum in the direction of arrow i, and a capacity allowing the piston 12 to move is left in the rod-side section 15. This configuration can prevent the piston 12 of the accelerating cylinder 3 from moving to maximum before the rod 6 of the actuating cylinder 2 fully retracts, and can ensure the intrinsic retraction amount of the rod 6 of the actuating cylinder 2.

Although FIG. 5 is described with an example of the circuit for unloaded condition in FIG. 2, the movement of the piston 5 of the actuating cylinder 2 is synchronized with the movement of the piston 12 of the accelerating cylinder 3 also in the circuit for loaded condition in FIG. 3. The effect as described above is therefore obtained also in the circuit for loaded condition in FIG. 3. Although, in the example described above, the capacity of oil in the tube 11 is set larger than the volume of oil in the tube 4 of the actuating cylinder 2 by increasing the tube length of the tube 11 of the accelerating cylinder 3, the present invention is not limited to this example. As long as the capacity of oil in the tube 11 of the accelerating cylinder 3 is set larger than the capacity of oil in the tube 4 of the actuating cylinder 2, the tube diameter may be increased or both the tube length and the tube diameter may be increased.

As previously mentioned, in the present embodiment, the motion of the piston 5 of the actuating cylinder 2 and the motion of the piston 12 of the accelerating cylinder 3 are synchronized with each other. The present embodiment further includes a configuration that can prevent lacking in movement amount of extension and retraction of the rod 6 of the actuating cylinder 2 even when the synchronization is imperfect.

In FIG. 2 illustrating an unloaded condition, the broken lines in the actuating cylinder 2 and the accelerating cylinder 3 illustrates the state in which synchronization between the actuating cylinder 2 and the accelerating cylinder 3 is imperfect. The broken line in the accelerating cylinder 3 illustrates a state in which the rod 13 is fully retracted, and the broken line in the actuating cylinder 2 illustrates a state in which the rod 6 is not fully extended. Since oil cannot be supplied to the bottom-side section 7 of the actuating cylinder 2 through the first bottom line 26 and the second bottom line 27 in this state, the rod 6 of the actuating cylinder 2 cannot be extended from the state illustrated with the broken line.

In FIG. 2, a first relief line 54 is connected between the supply/discharge line 20 and the pilot line 40. A first relief valve 50 is interposed in the first relief line 54. If oil is kept supplied to the rod-side section 15 of the accelerating cylinder 3 from the supply/discharge line 20 with the rod 13 of the accelerating cylinder 3 being fully retracted, the pressure in the supply/discharge line 20 rises. If this pressure exceeds the setting pressure of the first relief valve 50, the first relief valve 50 is opened to allow circulation, and oil supplied to the supply/discharge line 20 is supplied to the bottom-side section 7 of the actuating cylinder 2 through the first relief line 54, the pilot line 40, and the second bottom line 27. This causes the rod 6 of the actuating cylinder 2 in the position illustrated with the broken line to move until it fully extends.

The state in which the rod 6 of the actuating cylinder 2 is fully extended is the same as the state in which synchronization between the accelerating cylinder 3 and the actuating cylinder 2 is effected properly, that is, the same as the initial state in which retraction of the rod 6 of the actuating cylinder 2 is started. In other words, when the rod 6 of the actuating cylinder 3 retracts, synchronization between the actuating cylinder 2 and the accelerating cylinder 3 starts from the state in which the piston 5 of the actuating cylinder 2 and the piston 12 of the accelerating cylinder 3 are in the normal position.

The present embodiment can thus prevent lacking in movement amount of the rod 6 of the actuating cylinder 2 even when synchronization between the actuating cylinder 2 and the accelerating cylinder 3 is imperfect. In addition, synchronization between the actuating cylinder 2 and the accelerating cylinder 3 can be restarted in a state in which the positional relationship between the piston 5 of the actuating cylinder 2 and the piston 12 of the accelerating cylinder 3 is returned to the normal position. This is the same in a loaded condition and when the rod 6 of the actuating cylinder 2 retracts as described below.

In FIG. 3 illustrating a loaded condition, the broken lines in the actuating cylinder 2 and the accelerating cylinder 3 illustrates the state in which synchronization between the actuating cylinder 2 and the accelerating cylinder 3 is imperfect. The broken line in the accelerating cylinder 3 illustrates a state in which the rod 13 is fully retracted, and the broken line in the actuating cylinder 2 illustrates a state in which the rod 6 is not fully extended. In this state, oil from the rod-side section 8 of the actuating cylinder 2 cannot be supplied to the rod-side section 15 of the accelerating cylinder 3 through the second rod line 28 and the first rod line 24, and the rod 6 of the actuating cylinder 2 cannot be extended from the state illustrated with the broken line.

A second relief line 55 is connected between the second rod line 28 and the supply/discharge line 21. A second relief valve 51 is interposed in the second relief line 55. If oil is kept supplied to the bottom-side section 7 of the actuating cylinder 2 from the supply/discharge line 20 and the second bottom line 27 with the rod 13 of the accelerating cylinder 3 being fully retracted, the pressure in the second rod line 28 rises. If this pressure exceeds the setting pressure of the second relief valve 51, the second relief valve 51 is opened to allow circulation, and oil discharged from the rod-side section 8 of the actuating cylinder 2 is discharged through the second relief line 55 and the supply/discharge line 21. The rod 6 of the actuating cylinder 2 at the position illustrated with the broken line moves until it fully extends.

The state in which the rod 6 of the actuating cylinder 2 is fully extended is the same as the state in which synchronization between the accelerating cylinder 3 and the actuating cylinder 2 is effected properly, that is, the same as the initial state in which retraction of the rod 6 of the actuating cylinder 2 is started. Accordingly, when the rod 6 of the actuating cylinder 2 retracts, synchronization between the actuating cylinder 2 and the accelerating cylinder 3 starts from, the state in which the piston 5 of the actuating cylinder 2 and the piston 12 of the accelerating cylinder 3 are in the normal position.

In FIG. 4 illustrating the retraction of the rod 6 of the actuating cylinder 2, the broken lines in the actuating cylinder 2 and the accelerating cylinder 3 illustrates a state in which synchronization between the actuating cylinder 2 and the accelerating cylinder 3 is imperfect. The broken line in the accelerating cylinder 3 illustrates a state in which the rod 13 is folly extended, and the broken line in the actuating cylinder 2 illustrates a state in which the rod 6 is not fully retracted. In this state, oil from the bottom-side section 7 of the actuating cylinder 2 cannot be supplied to the bottom-side section 14 of the accelerating cylinder 3 through the second bottom line 27 and the first bottom line 26, and the rod 6 of the actuating cylinder 2 cannot be retracted from the state illustrated with the broken line.

A third relief line 56 is connected between the first bottom line 26 and the supply/discharge line 20. A third relief valve 52 is interposed in the third relief line 56. If oil is kept supplied from the supply/discharge line 21 and the second rod line 28 to the rod-side section 8 of the actuating cylinder 2, the pressure in the second bottom line 27 and the first bottom line 26 rises. If this pressure exceeds the setting pressure of the third relief valve 52, the third relief valve 52 is opened to allow circulation, and oil discharged from the bottom-side section 7 of the actuating cylinder 2 is discharged through the third relief line 56 and the supply/discharge line 20. The rod 6 of the actuating cylinder 2 in the position illustrated with the broken line then moves to until it fully retracts.

The state in which the rod 6 of the actuating cylinder 2 is fully retracted is the same as the state in which synchronization between the accelerating cylinder 3 and the actuating cylinder 2 is effected properly, that is, the same as the initial state in which the extension of the rod 6 of the actuating cylinder 2 is started. Accordingly, when the rod 6 of the actuating cylinder 2 extends, synchronization between the actuating cylinder 2 and the accelerating cylinder 3 starts from the state in which the piston 5 of the actuating cylinder 2 and the piston 12 of the accelerating cylinder 3 are in the normal position.

Although an example is raised in which three relief lines 54 to 56 are provided in the present embodiment includes, the relief lines 54 to 56 take effect when synchronization becomes imperfect as previously described. The relief lines 54 to 56 therefore may not be provided unless imperfect synchronization occurs, or at least one of the relief lines 54 to 56 may be provided.

Figure 7:
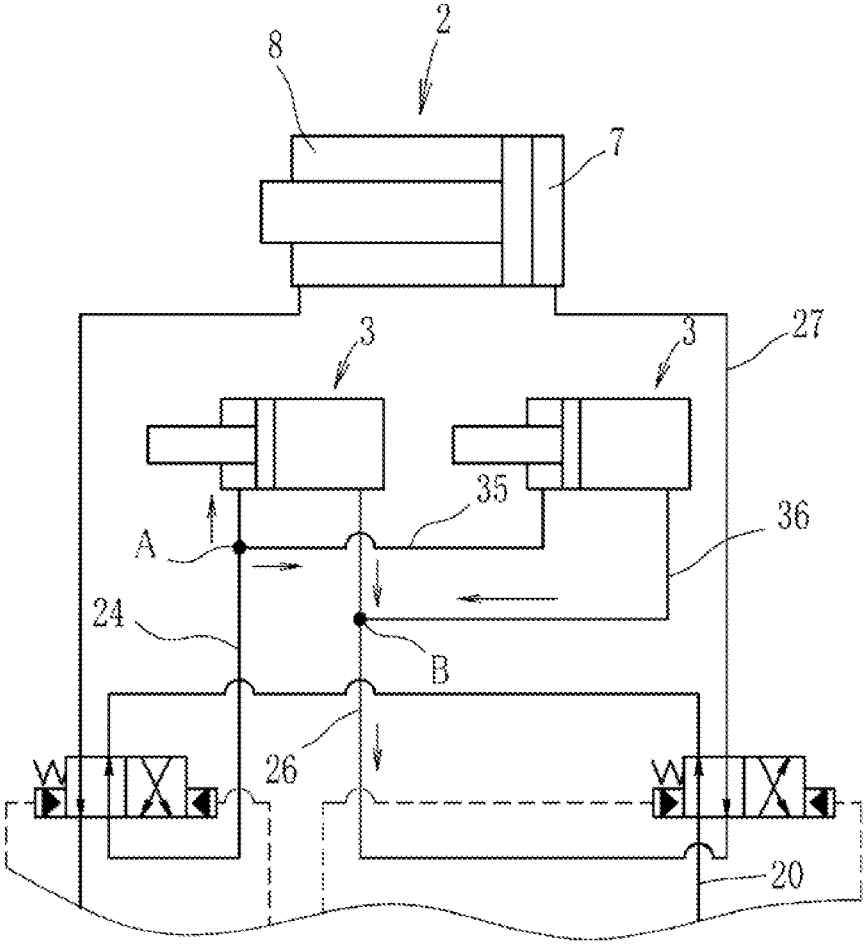
FIG. 7 is a diagram illustrating an embodiment of the present invention including a plurality of accelerating cylinders.

Although the embodiment above includes the single accelerating cylinder 3, the plurality of accelerating cylinders 3 may be provided. FIG. 7 illustrates an example provided with two accelerating cylinders 3. FIG. 7 illustrates a circuit for unloaded condition as in FIG. 2. The total capacity in the two accelerating cylinders 3 in FIG. 7 is equal to the volume in the actuating cylinder 2. The two accelerating cylinders 3 in FIG. 7 have the same specifications as the accelerating cylinder 3 in FIG. 2, excluding the capacity, with the same supply-discharge ratio of 2:1. The circuit in FIG. 7 additionally includes a third rod line 35 and a third bottom line 36 and another accelerating cylinder 3 in the circuit of FIG. 2.

The oil flowing through the first rod line 24 toward the accelerating cylinder 3 is divided at a branch point A into a flow that directly passes through the first rod line 24 and a flow that passes through the third rod line 35. It is assumed that oil at a flow rate of "1" before division is divided into two flows each with a flow rate of "0.5". Each accelerating cylinder 3 is fed with oil at a flow rate of "0.5" and discharges oil at a flow rate of "1". The oils at a flow rate of "1" discharged from the accelerating cylinders 3 are combined at a branch point B into a flow at a flow rate of "2", which in turn passes through the first bottom line 26 and the second bottom line 27 to be supplied to the bottom-side section 7 of the actuating cylinder 2. Oil at a flow rate of "1" is then discharged from the rod-side section 8 of the actuating cylinder 2.

Accordingly, in the circuit in FIG. 7, if oil at a flow rate of "1" is supplied from the supply/discharge line 20, oil at a flow rate of "2" is supplied to the actuating cylinder 2, and oil at a flow rate of "1" is discharged from the actuating cylinder 2, in the same manner as in the circuit in FIG. 2. That is, if the number of accelerating cylinders 3 is increased, a circuit equivalent to the circuit in FIG. 2 is configured. Increasing the number of accelerating cylinders 3 reduces the volume in each accelerating cylinder 3 and reduces a space required for installation of each accelerating cylinder 3. An empty space in a target machine, in which the hydraulic system 1 is installed, is effectively utilized for installing an accelerating cylinder 3. Although the example in FIG. 7 includes two accelerating cylinders 3, the volume for each accelerating cylinder 3 can be reduced by providing three or more accelerating cylinders 3.

Figure 8:
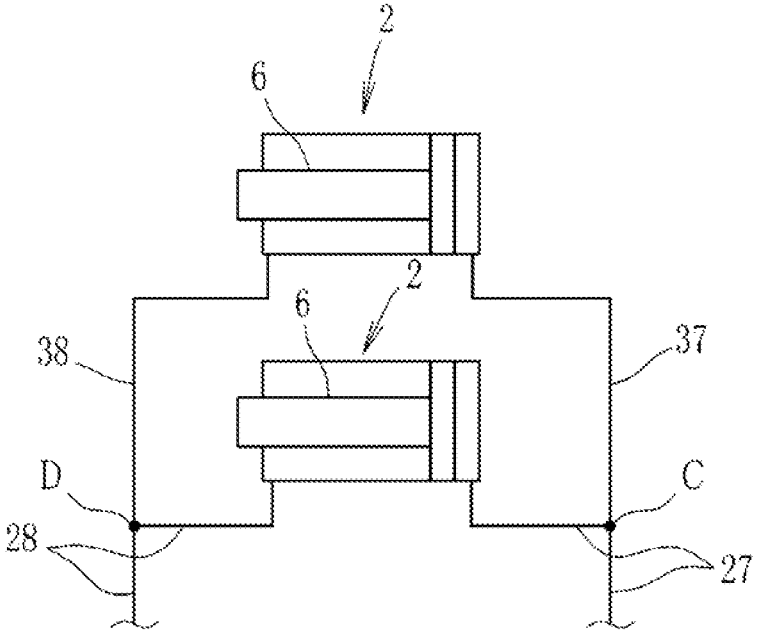
FIG. 8 is a diagram illustrating an embodiment of the present invention including a plurality of actuating cylinders.

Although an example is raised in which the single actuating cylinder 2 are provided in the embodiment above, the plurality of actuating cylinders 2 may be provided. For example, in the crusher 10 of FIG. 1, the lower jaw 19 alone is driven by the actuating cylinder 2. However, by using two actuating cylinders 2, both the upper jaw 18 and the lower jaw 19 can be driven by the actuating cylinders 2. FIG. 8 illustrates an example with two actuating cylinders 2. Although FIG. 8 merely illustrates the vicinity of the actuating cylinders 2, the circuit partially not illustrated is the same as the circuit in FIG. 2. In FIG. 8, a third bottom line 37 and a third rod line 38 are added, and another actuating cylinder 2 is added. The accelerating cylinder 3 may be configured to have a capacity in accordance with the total volume in the two actuating cylinders 2.

As explained with reference to FIG. 2, if oil at a flow rate of "1" is supplied to the supply/discharge line 20 in an unloaded condition, oil at a flow rate of "2" is supplied to the second bottom line 27. The oil flowing through the second bottom line 27 toward the actuating cylinder 2 is divided at a branch point C into a flow that directly passes through the second bottom line 27 and a flow that passes through, the third bottom line 37. It is assumed that oil at a flow rate of "2" before division is divided into two flows each with a flow rate of "1". In this case, each actuating cylinder 2 is fed with oil at a flow rate of "1" and discharges oil at a flow rate of "0.5". The oils at a flow rate of "0.5" discharged from the actuating cylinders 2 are combined at a branch point D into a flow at a flow rate of "1", which in turn passes through the second rod line 28 to be discharged from the supply/discharge line 21.

In this example, if oil at a flow rate "1" is supplied to the supply/discharge line 20, oil at a flow rate of "1" is supplied to each actuating cylinder 2. For comparison, in an example with no accelerating cylinder 3 in which oil is directly supplied to the actuating cylinder 2, if a flow rate of "1" from the source is supplied, oil at a flow rate of "0.5" is supplied to each actuating cylinder 2. The flow rate "0.5" is half of the flow rate "1" in the present embodiment. Accordingly, the configuration having two actuating cylinders 2 in the present embodiment can increase the extension speed of the rod 6 when compared with a configuration having two actuating cylinders 2 with no accelerating cylinder 3.

In the example above, the flow rate of supply to each actuating cylinder 2 is half of that in the example having the single actuating cylinder 2. However, this is not disadvantageous in terms of the accelerating effect, because, in the configuration in which both the upper jaw 18 and the lower jaw 19 are driven by the actuating cylinders 2 as described above, both the upper jaw 18 and the lower jaw 19 move to close the crusher 10.

Although the examples are raised as above in which the accelerating cylinder 3 or the actuating cylinder 2 is plural, respectively, both of the accelerating cylinder 3 and the actuating cylinder 2 may be plural.

Although the example is raised in which the hydraulic system of the present invention is used in the crusher in the embodiment above, the crusher is not limited to the configuration illustrated in FIG. 1 as long as it can crush an object by moving at least one jaw. The applications of the hydraulic system in the present invention are not limited to a crusher. In a hydraulic system including an actuating cylinder and an accelerating cylinder added to configure an acceleration circuit, since the present invention is capable of stabilizing a switching operation from an unloaded condition to a loaded condition, the present invention can be used as a hydraulic system for a variety of hydraulic machines such as press machines.

Although the first switch valve 31, the second switch valve 32, and the third switch valve 33 switches between the circuit for unloaded condition and the circuit for loaded condition in the embodiment above, the present invention is not limited to this example. The circuit may be configured by appropriately selecting a structure and number of switch valves to configure circuits such that the circuits for driving the actuating cylinder 2 and the accelerating cylinder 3 are equivalent to the circuits illustrated in FIG. 2 and FIG. 3.

INDUSTRIAL APPLICABILITY

Since the hydraulic system according to the present invention allows a stable switching operation from an unloaded condition to a loaded condition as described above, it is useful as a hydraulic system for a variety of hydraulic machines such as crushers and press machines.

DESCRIPTION OF REFERENCE SIGNS

1 hydraulic system
2 actuating cylinder
3 accelerating cylinder
4, 11 tube
5, 12 piston
6, 13 rod
7, 14 bottom-side section
8, 15 rod-side section
10 crusher
20, 21 supply/discharge line
24 first rod line
26 first bottom line
27 second bottom line
28 second rod line
50 first relief valve
51 second relief valve
53 third relief valve
54 first relief line
55 second relief line
56 third relief line

What is claimed is:

1. A hydraulic system comprising:

an actuating cylinder and an accelerating cylinder, the actuating cylinder and the accelerating cylinder each including, a piston, a rod moving integrally with the piston, and a tube containing the piston and the rod, the tube being divided into a rod-side section on the rod side and a bottom-side section on the opposite side to the rod with the piston interposed therebetween;

a first switch valve, a second switch valve, and a third switch valve switching a circuit for unloaded condition and a circuit for loaded condition;

a supply/discharge line being a source of oil supply; and a bottom line allowing connection between the bottom-side section of the accelerating cylinder and the bottom-side section of the actuating cylinder, wherein when the rod of the actuating cylinder is extended in unloaded condition, based on a setting of the first switch valve and the second switch valve, a circuit is configured such that oil is supplied from the supply/discharge line to the rod-side section of the accelerating cylinder and oil discharged from the bottom-side section of the accelerating cylinder is supplied to the bottom-side section of the actuating cylinder through the bottom line, when the rod of actuating cylinder is extended in loaded condition, based on a setting of the first switch valve and the second switch valve, a circuit is configured such that oil from the supply/discharge line is supplied to the bottom-side section of the actuating cylinder without passing through the accelerating cylinder, and the first switch valve and the second switch valve switches the circuit for unloaded condition to the circuit for loaded condition by switching a setting of the third switch valve based on a pressure in the bottom line.

2. The hydraulic system according to claim 1, wherein the first switch valve is interposed in the bottom line, the bottom line includes a first bottom line connecting the bottom-side section of the accelerating cylinder with the first switch valve and a second bottom line connecting the bottom-side section of the actuating cylinder with the first switch valve, in the unloaded condition, the first switch valve connects the first bottom line and the second bottom line, in the loaded condition, the first switch valve connects the supply/discharge line and the second bottom line through switching the setting of the third valve based on a pressure in the second bottom line.

3. The hydraulic system according to claim 1, wherein a capacity of oil in the accelerating cylinder is larger than a capacity of oil in the actuating cylinder.

4. The hydraulic system according to claim 1, further comprising a first relief line interposing a first relief valve, the first relief valve being opened by the pressure of oil supplied to the rod-side section of the accelerating cylinder when the rod of the actuating cylinder being extended in the unloaded condition, wherein in case the rod of the actuating cylinder is to be extended in the unloaded condition when the rod of the accelerating cylinder is fully retracted before the rod of the actuating cylinder is fully extended, oil that has been supplied to the rod-side section of the accelerating cylinder is supplied to the bottom-side section of the actuating cylinder through the first relief line.

5. The hydraulic system according to claim 1, further comprising a second relief line interposing a second relief valve, the second relief valve being opened by the pressure of oil discharged from the rod-side section of the actuating cylinder when the rod of the actuating cylinder being extended in the loaded condition, wherein when the rod of the actuating cylinder is extended in the loaded condition, a circuit is configured such that oil discharged from the rod-side section of the actuating cylinder is supplied to the rod-side section of the accelerating cylinder, in case the rod of the actuating cylinder is to be extended in the loaded condition when the rod of the accelerating cylinder is fully retracted before the rod of the actuating cylinder is fully extended, oil that has been discharged from the rod-side section of the actuating cylinder and supplied to the rod-side section of the accelerating cylinder is discharged through the second relief line.

6. The hydraulic system according to claim 1, further comprising a third relief line interposing a third relief valve, the third relief valve being opened by the pressure of oil discharged from the bottom-side section of the actuating cylinder when the rod of the actuating cylinder is retracted, wherein when the rod of the actuating cylinder is retracted, a circuit is configured such that oil is supplied to the rod-side section of the actuating cylinder and oil discharged from the bottom-side section of the actuating cylinder is supplied to the bottom-side section of the accelerating cylinder, in case the rod of the actuating cylinder is to be retracted when the rod of the accelerating cylinder is fully extended before the rod of the actuating cylinder is fully retracted, oil that has been discharged from the bottom-side section of the actuating cylinder and supplied to the bottom-side section of the accelerating cylinder is discharged through the third relief line.

7. The hydraulic system according to claim 1, wherein the accelerating cylinder is plural, when the rod of the actuating cylinder is extended in unloaded condition, oil is supplied from the supply/discharge line to the rod-side section of each accelerating cylinder, and oil discharged from the bottom-side section of each accelerating cylinder is supplied to the bottom-side section of the actuating cylinder through the bottom line.

8. The hydraulic system according to claim 1, wherein the actuating cylinder is plural, oil discharged from the bottom-side section of the accelerating cylinder is supplied to the bottom-side section of each actuating cylinder through the bottom line.

* * * * *